US005992756A

United States Patent [19]

Newcombe et al.

[11] Patent Number: 5,992,756

[45] Date of Patent: Nov. 30, 1999

[54] METHOD AND APPARATUS FOR EJECTION OF PARTICULATE MATERIAL

[75] Inventors: Guy Charles Fernley Newcombe; Martin Goodchild, both of Cambridge, United Kingdom

[73] Assignee: Tonejet Corporation Pty. Ltd., Eastwood, Australia

[21] Appl. No.: 09/101,610

[22] PCT Filed: Jan. 22, 1997

[86] PCT No.: PCT/GB97/00187

§ 371 Date: Jul. 17, 1998

§ 102(e) Date: Jul. 17, 1998

[87] PCT Pub. No.: WO97/27057

PCT Pub. Date: Jul. 31, 1997

[30] Foreign Application Priority Data

Jan. 22, 1996 [GB] United Kingdom ..... 9601232

[51] Int. Cl.[6] ..... B05B 17/04

[52] U.S. Cl. ..... 239/4; 239/102.2; 347/54; 347/55

[58] Field of Search ..... 239/4, 102.2, 102.1; 347/54, 55, 84, 103, 68, 70, 71, 154, 123, 111, 139, 127, 128, 17, 141, 120, 151

[56] References Cited

U.S. PATENT DOCUMENTS

| | | | |
|---|---|---|---|
| 3,717,875 | 2/1973 | Arciprete et al. | 239/102.2 |
| 3,979,756 | 9/1976 | Helinski et al. | 347/54 |
| 4,245,225 | 1/1981 | Fillmore et al. | 347/55 |
| 4,523,202 | 6/1985 | Gamblin | 239/102.2 |
| 4,719,480 | 1/1988 | Elrod et al. | 347/55 |

FOREIGN PATENT DOCUMENTS

| | | | |
|---|---|---|---|
| 703080 | 9/1995 | European Pat. Off. | 347/55 |
| 1165452 | 12/1987 | Japan | 347/54 |
| 1204750 | 8/1989 | Japan | 347/55 |

*Primary Examiner*—Andres Kashnikow
*Assistant Examiner*—Lisa Ann Douglas
*Attorney, Agent, or Firm*—Andrus, Sceales, Starke & Sawall

[57] ABSTRACT

The invention concerns an apparatus for generation and ejection into air of discrete agglomerations of a particulate material with a proportion of liquid from a liquid having the particulate material therein. The apparatus defines an ejection location (128) and an electrical potential is applied to the ejection location to form an electric field at the location, and liquid (122) with the particulate material is supplied to the ejection location. An oscillating voltage (A) is applied to the ejection location, the magnitude of the voltage being below that required to cause ejection of particles from the ejection location, and an ejection voltage (B) is superimposed on the oscillating voltage additively with the oscillating voltage in order to cause the sum of the voltages at the ejection location to exceed the threshold required for ejection, when required.

8 Claims, 7 Drawing Sheets

METHOD AND APPARATUS FOR EJECTION OF PARTICULATE MATERIAL

BACKGROUND OF THE INVENTION

The present invention relates to a method and apparatus for generation and ejection into air of discrete agglomerations of particulate material with a proportion of liquid from a liquid having the particular material therein. Such a method is disclosed in WO-A-93/11866 (PCT/AU92/00665) and includes providing the particulate material to an ejection location, applying an electrical potential to the ejection location to form an electric field and causing agglomerations to form at the ejection location. The agglomerations are ejected away from the ejection location by electrostatic means.

In order to control the ejection of agglomeration and particles the electrical potential needs to be varied from below a threshold to above a threshold. However, it has been found that, in certain constructions, it is difficult to achieve full control and true drop-on-demand performance. The present invention sets out to overcome this problem.

SUMMARY OF THE INVENTION

According to the present invention there is provided an apparatus for generation and ejection into air of discrete agglomerations of a particulate material with a proportion of liquid from a liquid having the particulate material therein, comprising an ejection location, means to apply an electrical potential to the ejection location to form an electric field at the location and means to supply liquid with the particulate material to the ejection location characterised by means for applying an oscillating voltage to the ejection location, the magnitude of said voltage being below that required to cause ejection of particles from the ejection location; and, means for superimposing an ejection voltage on the oscillating voltage additively with the oscillating voltage in order to cause the sum of the voltages at the ejection location to exceed the threshold required for ejection, when required.

By this means, the ejection voltage superimposed upon the oscillating voltage, when applied for less than one period of the oscillation voltage will enable a single drop to be ejected from the head thus enabling drop-on-demand operation.

The invention also includes the method of using that apparatus wherein an oscillating voltage is applied to the ejection location, the magnitude of the oscillating voltage being below that required to cause ejection of particles from the ejection location and an ejection voltage being superimposed on the oscillating voltage additively with the oscillating voltage in order to cause some of the voltages at the ejection location to exceed the threshold required for ejection, when required.

BRIEF DESCRIPTION OF THE SEVERAL VIEWS OF THE DRAWINGS

One example of a method and apparatus according to the present invention will now be described with reference to the accompanying drawings in which.

DETAILED DESCRIPTION OF THE INVENTION

Figure 1:
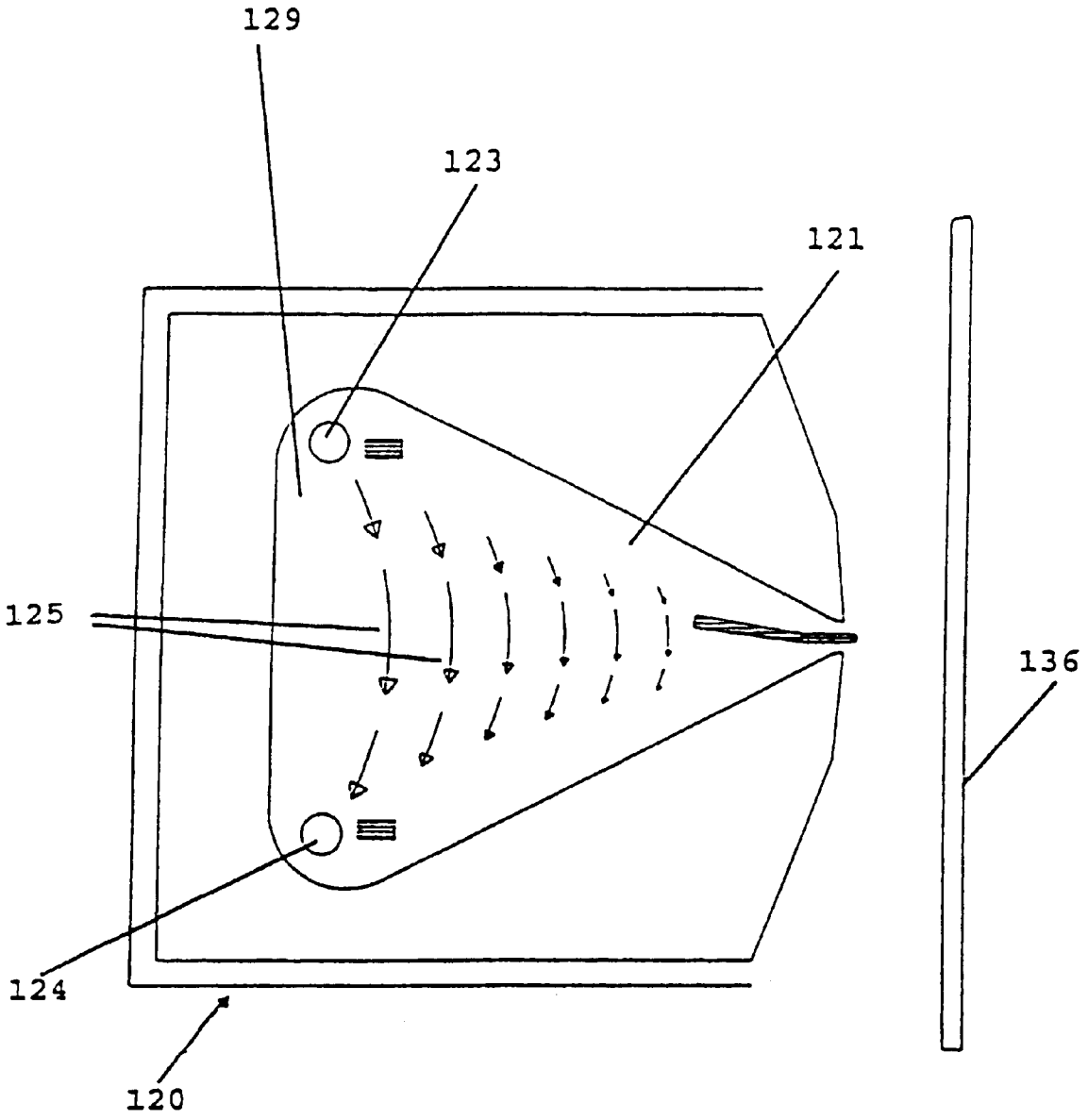
FIG. 1 illustrates, diagrammatically, a cell of a printhead in section, together with flow vectors.

FIGS. 1 to 3A show one cell of a printhead which incorporates a plurality of such cells for use in accordance with the present invention, the printhead using an electrophoretic method (as described generally in PCT/GB95/01215) in connection with FIG. 1) of concentrating insoluble ink particles. The printhead shown and described provides single pixel printing on a surface.

The printhead utilises concentration cells 120 of generally triangular internal shape, providing a cavity 121 to which an ink 122 is supplied under pressure (for example from a pump—not shown) through an inlet 123 and defining an ejection location for the particles in the fluid. To enable continuous operation, an outlet 124 is provided so that a flow vector distribution, as indicated in FIG. 1 by the arrows 125, is produced in operation. The cell shown has external dimensions of 10 mm width, 13.3 mm overall length and thickness 6 mm.

Figure 2A:
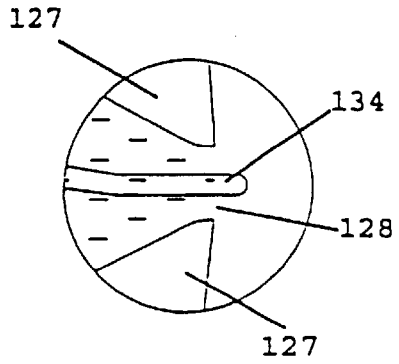
FIGS. 2,2A, 3 & 3A illustrate the same cell in greater detail, in section.
Figure 2:
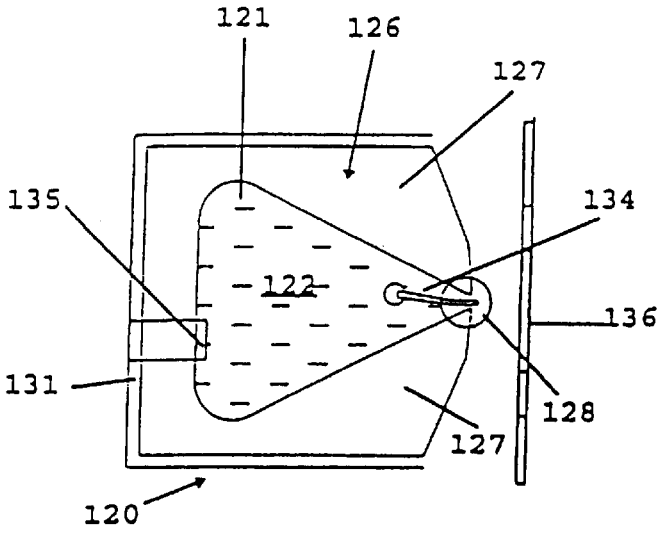
Figure 3:
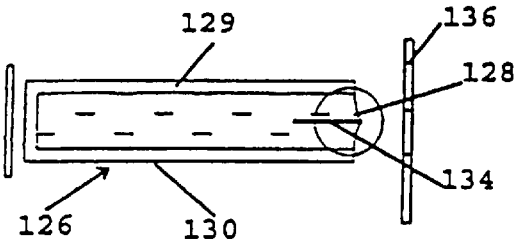
Figure 3A:
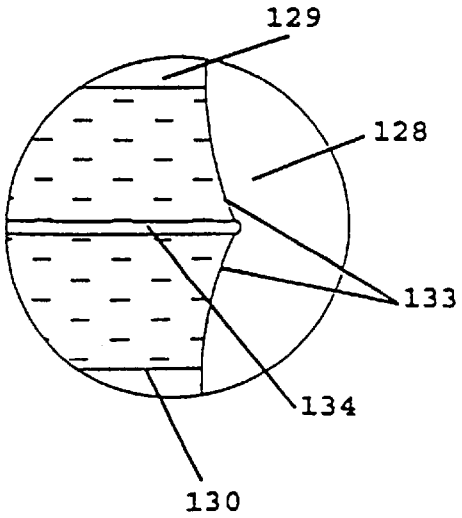

The cell 120 comprises a PEEK (Poly Ether Ether Ketone) housing 126 which, in section as seen in FIGS. 2 & 3, has opposed generally wedge-shaped cheeks 127 which define the triangular shape of the cavity 121 and an aperture 128. The aperture 128 has a width of about 100 $\mu$m. FIGS. 2A & 3A illustrate, respectively, details of the aperture 128 and the ink meniscus 133 which is formed there in use. At each wide face, the cell is closed by plastics side walls 129, 130 which form part of the housing 126. The housing 126 may form part of a larger assembly providing support fixings and the like. These are not shown as they do not affect the principle of operation and are unnecessary in the present context.

Disposed around the outside of the cell 120 is a thin plate-like electrode 131. The electrode 131 surrounds the narrower side walls provided by the cheeks 127 and the base portion of the plastic housing 126 and has a tab or tongue 135 which projects into the cavity 121 in order to make contact with the ink 122. The electrode 131 (known as the electrophoretic electrode) and the cheeks 127 are shaped such that, in use, a component of electric field vectors E in the liquid directs the insoluble ink particles away from the walls of the cell. In other words, E.n>0 around most of the perimeter of the ink cell 120, where E is the electric field vector and n is the surface normal, measured from the wall into the liquid. This ensures that the insoluble ink particles are not adsorbed on the perimeter of the cell which would otherwise modify the electric field of the cell.

Within the aperture 128, there is disposed an ejection electrode 134 (in an alternative embodiment, for multiple pixel printing, plural electrodes 134' may be provided in an array). The electrode 134 is electroformed nickel of 15 $\mu$m thickness with a cross-section typical of electroformed parts. One face of the electrode is flat and the other face is slightly curved. Ink particles are ejected onto a substrate 136 in use.

Figure 4A:
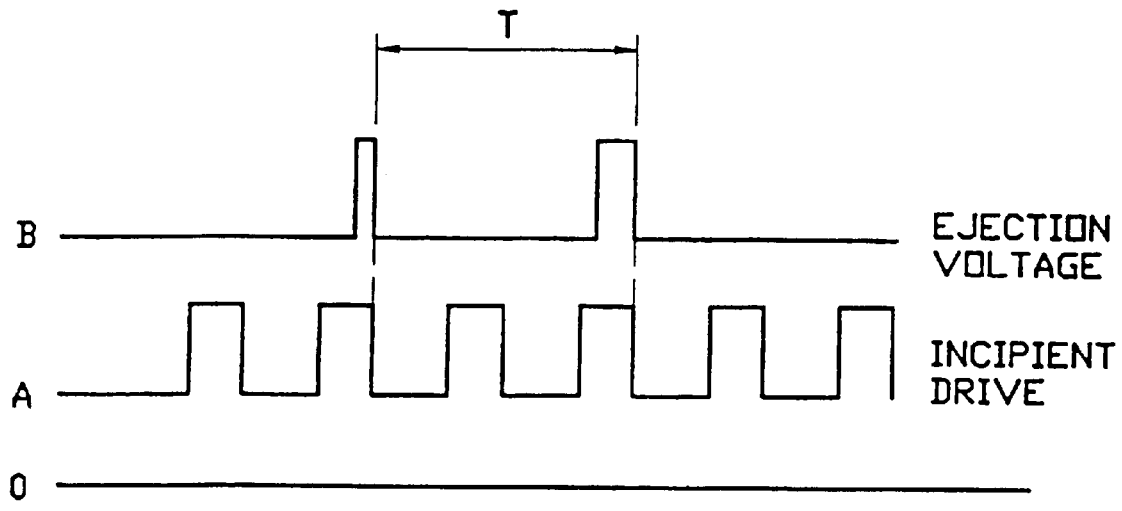
FIGS. 4A & 4B illustrate waveforms for the voltages applied to the electrode in the cell.
Figure 4B:
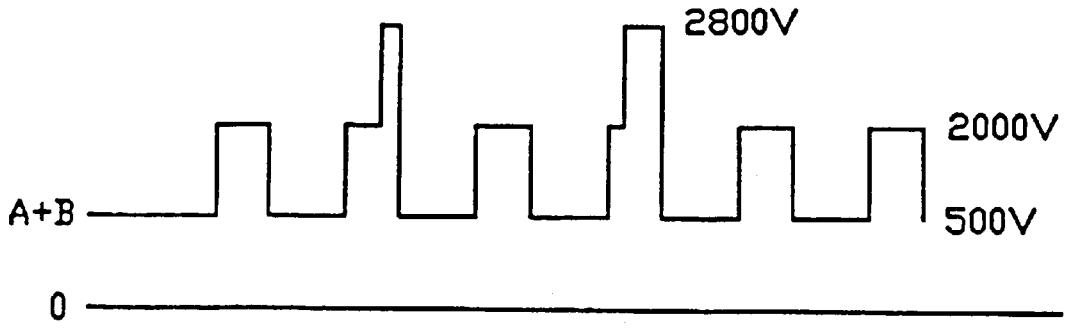

FIG. 4A illustrates, with respect to ground, the oscillating voltage applied to the electrode 134 (waveform A) and the ejection voltage (waveform B) superimposed on the oscillating voltage. It can be seen that the voltages are timed such that the falling edge of an ejection voltage pulse coincides with the falling edge of the incipient drive pulse or oscillating voltage and that the length of an ejection pulse is smaller than that of the oscillating voltage pulse. The resulting voltage on the ejection electrode 134 is shown in FIG. 4B with suitable values shown attached to the voltage pulses. By varying the length of the ejection voltage pulses it is possible to achieve a grey scale effect in printing.

Figure 5:
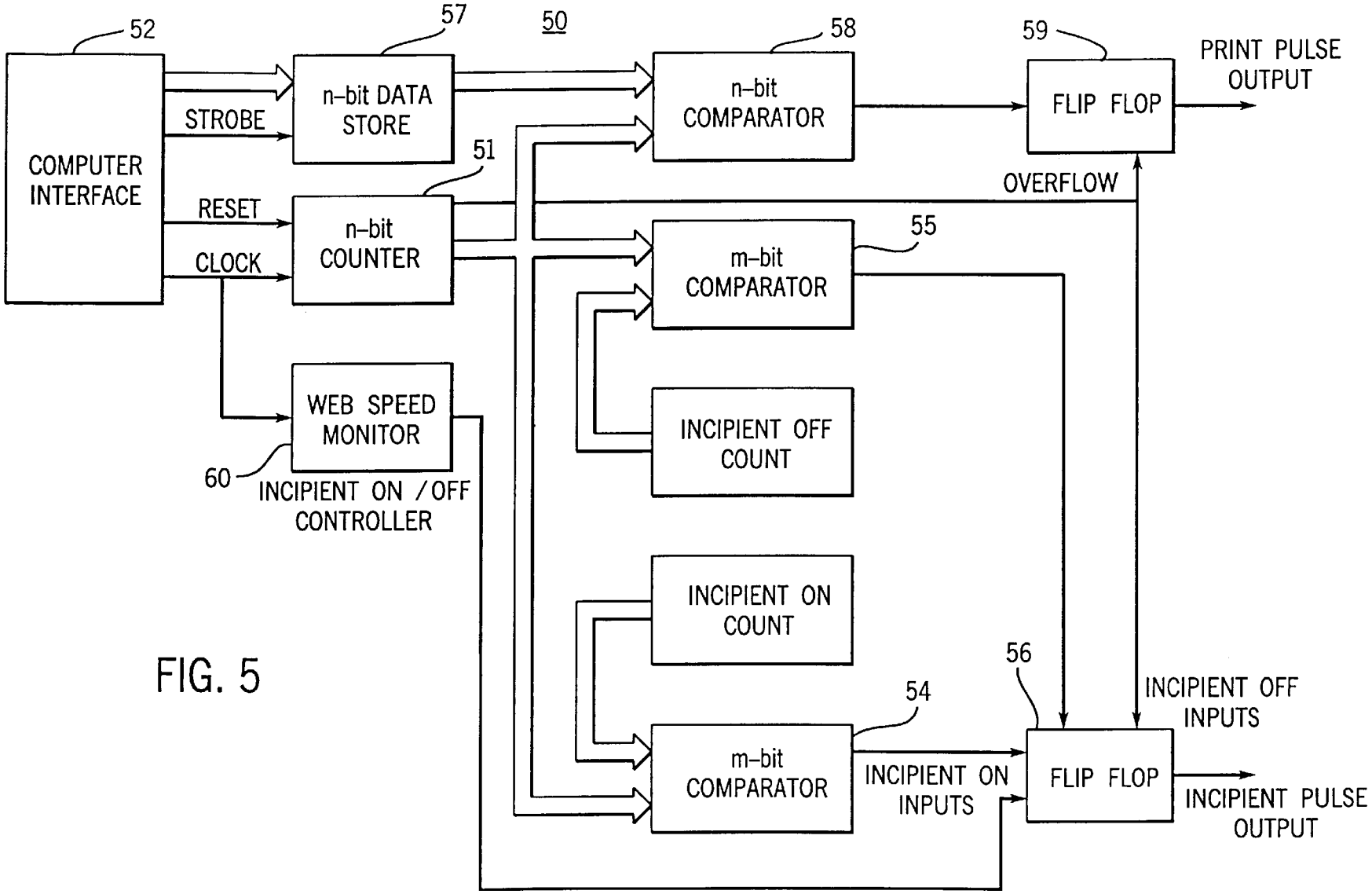
FIG. 5 is a block diagram of an incipient drive control.

An incipient drive controller 50 illustrated in FIG. 5 provides a means for generating and applying the voltage waveforms A and B. In order to obtain reliable synchronisation of the two waveforms, the time period T of one print cycle is divided into equal time segments. The number of these segments is determined by the resolution or number of grey-scales required.

The print cycle is started by a computer 52 issuing a reset signal which sets the segment number to 0 and starts the segment counter 51 which is incremented by a clock signal from the computer 52. This clock signal may be either a constant frequency or a variable frequency related to the printing speed required, which for example may be determined by the speed of the substrate 136 in relation to the cell 120.

The oscillating voltage (waveform A) is generated by an incipient drive pulse on comparator 54 and an incipient drive pulse off comparator 55. Each comparator 54,55 compares the number of time segments that have passed with a desired number of segments after which the flip-flop 56 should be activated. The output of the flip-flop 56 creates the oscillating voltage output.

The start time of an ejection voltage pulse occurs after a variable number x of time segments has passed. The variable x, which is stored in an image data store 57, depends upon the length of ejection voltage pulse required and the number of time segments in time T of the print cycle. According to x and the number of time segments counted by the segment counter 51 the comparator 58 outputs a signal to a flip-flop 59 which, in turn, initiates an ejection voltage pulse.

When time T has elapsed the segment counter reaches a maximum segment count for the print cycle and outputs an overflow signal to both flip-flops 56 and 59, ensuring that both the ejection voltage pulse and the incipient drive pulse end at the same time.

It should be noted that the substrate speed monitor 60 may also be used to control the oscillating voltage.

Of course, it will be appreciated that in an array of printhead cells, individual cells will be individually applied with the ejection (as required) and incipient voltages to enable pixel by pixel printing in a drop-on-demand manner.

Figure 6:
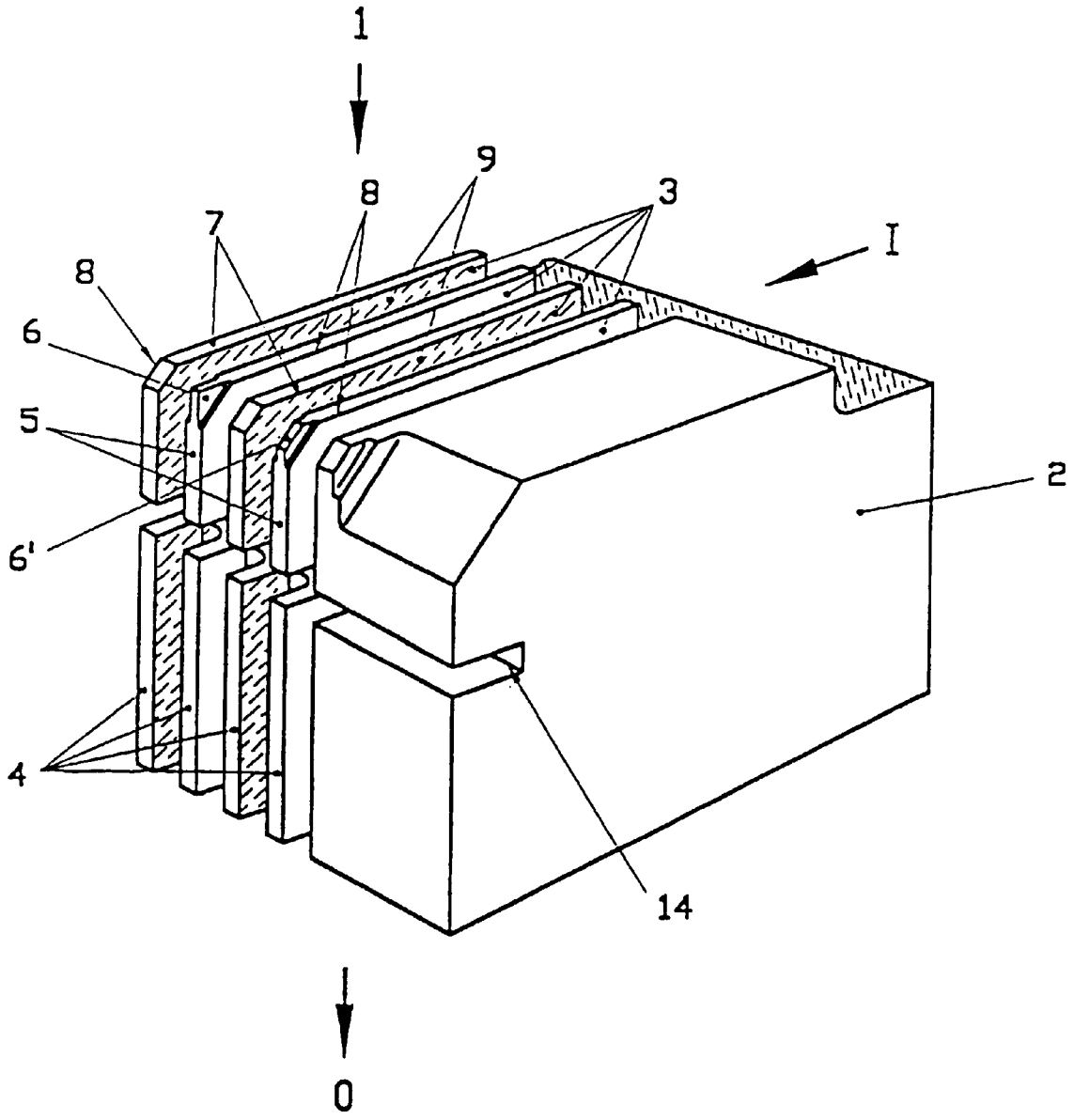
FIG. 6 is a partial perspective view of a portion of a second printhead incorporating ejection apparatus according to the present invention.

A further example is illustrated in FIGS. 6 to 9. FIG. 6 illustrates part of an array-type printhead 1, the printhead comprising a body 2 of a dielectric material such as a synthetic plastics material or a ceramic. A series of grooves 3 are machined in the body 2, leaving interposing plate-like lands 4. The grooves 3 are each provided with a ink inlet and ink outlet (not shown, but indicated by arrows I & O) disposed at opposite ends of the grooves 3 so that fluid ink carrying a material which is to be ejected (as described in our earlier applications) can be passed into the grooves and depleted fluid passed out.

Each pair of adjacent grooves 3 define a cell 5, the plate-like land or separator 4 between the pairs of grooves 3 defining an ejection location for the material and having an ejection upstand 6, 6'. In the drawing two cells 5 are shown, the left-hand cell 5 having an ejection upstand 6 which is of generally triangular shape and the right-hand cell 5 having a truncated ejection upstand. Each of the cells 5 is separated by a cell separator 7 formed by one of the plate-like lands 4 and the corner of each separator 7 is shaped or chamfered as shown so as to provide a surface 8 to allow the ejection upstand to project outwardly of the cell beyond the exterior of the cell as defined by the chamfered surfaces 8. A truncated ejection upstand 6' is used in the end cell 5 to reduce end effects resulting from the electric fields which in turn result from voltages applied to ejection electrodes 9 provided as metallised surfaces on the faces of the plate-like lands 4 facing the ejection upstand 6, 6' (ie. the inner faces of each cell separator). As can be seen from FIG. 8, the ejection electrodes 9 extend over the side faces of the lands 4 and the bottom surfaces 10 of the grooves 3. The precise extent of the ejection electrodes 9 will depend upon the particular design and purpose of the printer.

Figure 7:
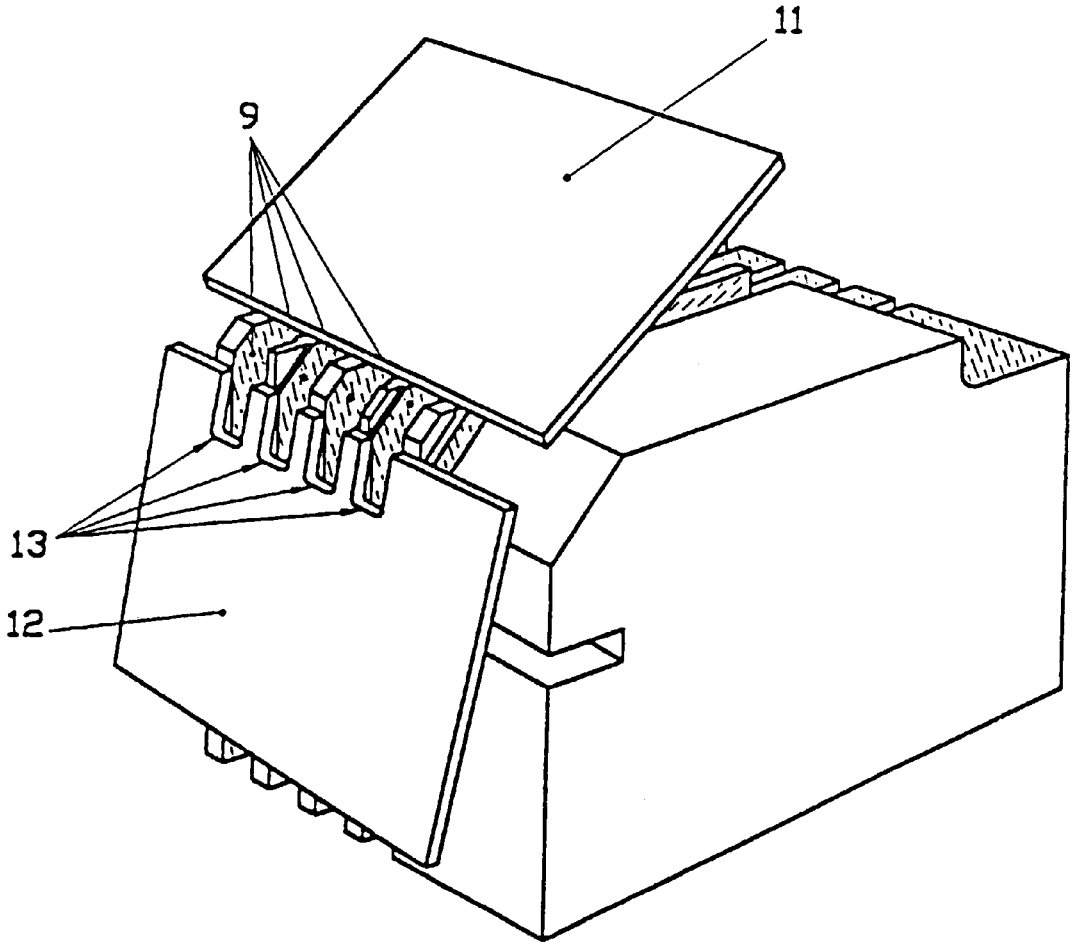
FIG. 7 is a view similar to FIG. 6 showing further and alternative features of the ejection apparatus.

FIG. 7 illustrates two alternative forms for side covers of the printer, the first being a simple straight-edged cover 11 which closes the sides of the grooves 3 along the straight line as indicated in the top part of the figure. A second type of cover 12 is shown on the lower part of the figure, the cover still closing the grooves 3 but having a series of edge slots 13 which are aligned with the grooves. This type of cover construction may be used to enhance definition of the position of the fluid meniscus which is formed in use and the covers, of whatever form, can be used to provide surfaces onto which the ejection electrode and/or secondary or additional electrodes can be formed to enhance the ejection process.

FIG. 7 also illustrates an alternative form of the ejection electrode 9, which comprises an additional metallised surface on the face of the land 4 which supports the ejection upstand 6, 6'. This may help with charge injection and may improve the forward component of the electric field.

Figure 8:
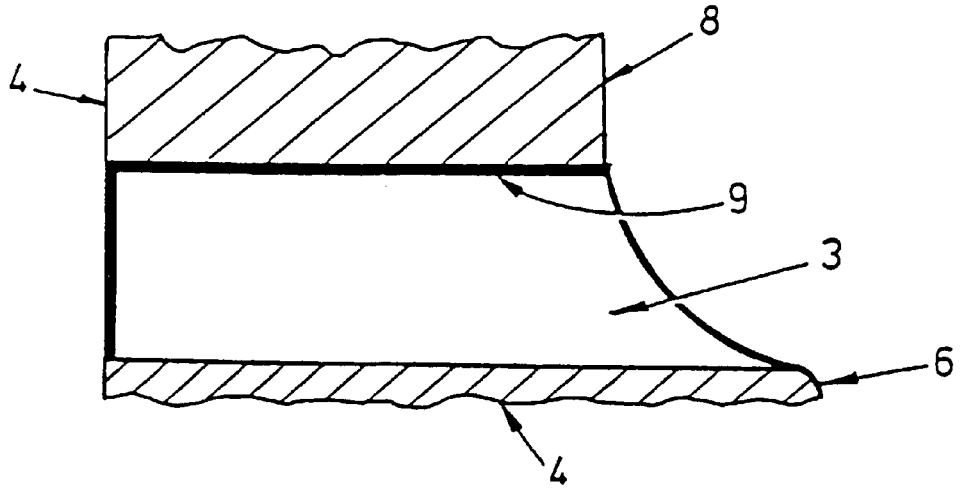
FIGS. 8 and 9 are partial sectional views through a cell of FIG. 6 and a modification thereof.
Figure 9:
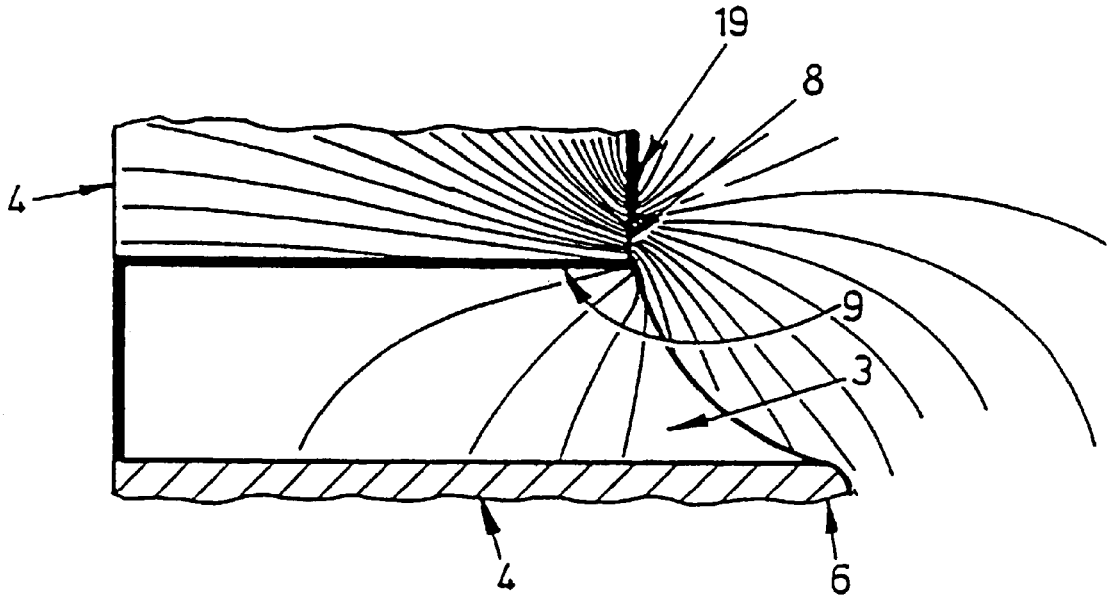

FIG. 8 illustrates a partial sectional view through one side of the one of the cells 5 of FIG. 6 and FIG. 9 an equivalent sectional view but indicating the presence of a secondary electrode 19 on the chamfered face 8. The same or similar voltages waveforms can be applied to the ejection electrode of this second printhead as in the case of the first print head shown in FIGS. 1 to 3A.

In either of the exemplified printheads, the oscillating voltage may be applied to different electrodes at the ejection location. For example, while the specific description above has described application to the ejection electrode 134, the voltage may be applied to a bias or secondary electrode of the type disclosed in our British Patent Application no. 9601226.5.

We claim:

1. A method of generating and ejecting into air discrete agglomerations of a particulate material with a proportion of liquid from a liquid having the particulate material therein from an ejection location, comprising steps of:

applying an electrical potential to the ejection location to form an electric field at the location; and supplying liquid with the particulate material to the ejection location;

characterised by applying an oscillating voltage to the ejection location, the magnitude of said voltage being below that required to cause ejection of particles from the ejection location; and, superimposing an ejection voltage on the oscillating voltage additively with the oscillating voltage in order to cause the sum of the voltages at the ejection location to exceed the threshold required for ejection, when required.

2. A method according to claim 1, further comprising the step of causing the end of an ejection voltage pulse to coincide with a fall in the oscillating voltage.

3. A method according to claim 2, further comprising the step of altering the length of the ejection voltage pulse.

4. A method according to claim 1, further comprising the step of altering the length of the ejection voltage pulse.

5. Apparatus for generation and ejection into air of discrete agglomerations of a particulate material with a proportion of liquid from a liquid having the particulate material therein, comprising:

an ejection location;

means to apply an electrical potential to the ejection location to form an electric field at the location; and means to supply liquid with the particulate material to the ejection location;

characterised by means for applying an oscillating voltage to the ejection location, the magnitude of said voltage being below that required to cause ejection of particles from the ejection location; and, means for superimposing an ejection voltage on the oscillating voltage additively with the oscillating voltage in order to cause the sum of the voltages at the ejection location to exceed the threshold required for ejection, when required.

6. Apparatus according to claim 5, further comprising means for causing the end of an ejection voltage pulse to coincide with a fall in the oscillating voltage.

7. Apparatus according to claim 6, further comprising means for altering the length of the ejection voltage pulse.

8. Apparatus according to claim 5, further comprising means for altering the length of the ejection voltage pulse.

* * * * *